US008864856B2

(12) United States Patent
Takafuji et al.

(10) Patent No.: US 8,864,856 B2
(45) Date of Patent: Oct. 21, 2014

(54) CIRCULATING FLUIDIZED BED GASIFICATION FURNACE

(75) Inventors: Makoto Takafuji, Tokyo (JP); Toshiyuki Suda, Tokyo (JP)

(73) Assignee: IHI Corporation, Tokyo (JP)

( * ) Notice: Subject to any disclaimer, the term of this patent is extended or adjusted under 35 U.S.C. 154(b) by 955 days.

(21) Appl. No.: 13/003,413

(22) PCT Filed: Jul. 10, 2009

(86) PCT No.: PCT/JP2009/003230

§ 371 (c)(1),
(2), (4) Date: Jan. 11, 2011

(87) PCT Pub. No.: WO2010/004760

PCT Pub. Date: Jan. 14, 2010

(65) Prior Publication Data

US 2011/0104014 A1 May 5, 2011

(30) Foreign Application Priority Data

Jul. 11, 2008 (JP) ..... 2008-181954

(51) Int. Cl.
*B01J 7/00* (2006.01)
*F23C 10/26* (2006.01)

(Continued)

(52) U.S. Cl.
CPC ..... *F23C 10/10* (2013.01); *C10J 2300/1807* (2013.01); *F23C 10/26* (2013.01); *C10J*

(Continued)

(58) Field of Classification Search
CPC ..... F23C 10/10; F23C 10/005; F23C 10/28; F23C 10/32; F23C 2206/101; F23C 10/26; F23C 2206/103; F23C 2900/10001; F23G 2203/501; F23G 5/30; F23G 2209/30; F23G 2203/503; F23G 2209/12; F23G 2207/101; F23G 2207/104; F23G 2207/106; F23G 2207/50; F23G 5/50; F23J 15/02; F23J 2217/40; F23J 15/08; F23J 1/00; F23J 2215/101; F23J 2900/01007; B01J 8/005; B01J 8/26; B01J 8/388; C10J 2300/0993; C10J 2300/1637; C10J 2300/1807; C10J 3/463
See application file for complete search history.

(56) References Cited

U.S. PATENT DOCUMENTS 4,419,965 A * 12/1983 Garcia-Mallol et al. ..... 122/4 D
5,003,931 A 4/1991 Huschauer (Continued)

FOREIGN PATENT DOCUMENTS

JP 57-144813 9/1982
JP 02 247407 10/1990

(Continued)

OTHER PUBLICATIONS

International Search Report issued Sep. 8, 2009 in PCT/JP09/003230 filed Jul. 10, 2009.

*Primary Examiner* — Imran Akram
(74) *Attorney, Agent, or Firm* — Oblon, Spivak, McClelland, Maier & Neustadt, L.L.P.

(57) ABSTRACT

A circulating fluidized bed gasification furnace has a combustion furnace 1, a cyclone collector 4 to which a combustion exhaust gas 3 from the combustion furnace 1 is introduced to collect a circulating medium 5, a fluidized bed gasification furnace 8 for formation of a fluidized bed 10 by introducing the circulating medium 5 collected in the cyclone collector 4 through a downcomer 7 and by supplying a gasification agent 9 from below and for gasification of a raw material 12 by supplying the same to a freeboard 11, and a circulation flow passage 14 for return of the circulating medium and unreacted char not gasified in the gasification furnace 8 to the combustion furnace 1. The downcomer 7 connected to the collector 4 has a lower end connected through a sealer 18 to the freeboard 11 in the gasification furnace 8. A raw material supply unit 20 is arranged to supply the raw material 12 to the circulating medium 5 between the sealer 18 and the freeboard 11.

3 Claims, 2 Drawing Sheets

(51) Int. Cl.
*F23C 10/32* (2006.01)
*C10J 3/46* (2006.01)
*F23C 10/10* (2006.01)

(52) U.S. Cl.
CPC . 2300/1637 (2013.01); *F23C 10/32* (2013.01); *C10J 2300/0993* (2013.01); *C10J 3/463* (2013.01); *F23C 2900/10001* (2013.01)
USPC ..... 48/61

(56) References Cited

U.S. PATENT DOCUMENTS

| | | | | |
|---|---|---|---|---|
| 5,048,432 | A * | 9/1991 | Hofmann et al. | 110/345 |
| 5,078,100 | A * | 1/1992 | Huschauer et al. | 122/4 D |
| 5,159,886 | A | 11/1992 | Schaub et al. | |
| 5,363,812 | A * | 11/1994 | Belin et al. | 122/4 D |
| 6,418,866 | B1 * | 7/2002 | Shimizu et al. | 110/347 |
| 6,431,095 | B2 * | 8/2002 | Malaubier et al. | 110/342 |
| 6,457,425 | B1 * | 10/2002 | Crafton et al. | 110/346 |
| 2004/0123786 | A1 * | 7/2004 | Crafton et al. | 110/346 |
| 2006/0075946 | A1 * | 4/2006 | Gounder | 110/346 |
| 2006/0180060 | A1 * | 8/2006 | Crafton et al. | 110/341 |
| 2009/0133611 | A1 * | 5/2009 | Morin et al. | 110/218 |
| 2010/0024297 | A1 * | 2/2010 | Suda et al. | 48/61 |
| 2010/0266477 | A1 * | 10/2010 | Ishii | 423/437.1 |

FOREIGN PATENT DOCUMENTS

| | | |
|---|---|---|
| JP | 05 203112 | 8/1993 |
| JP | 09 053814 | 2/1997 |
| JP | 2000 240920 | 9/2000 |
| JP | 2000-257828 | 9/2000 |
| JP | 2001 235128 | 8/2001 |
| JP | 2004-91568 | 3/2004 |
| JP | 2005-41959 | 2/2005 |
| JP | 2006 292275 | 10/2006 |
| JP | 2008 094928 | 4/2008 |

* cited by examiner

CIRCULATING FLUIDIZED BED GASIFICATION FURNACE

TECHNICAL FIELD

The present invention relates to a circulating fluidized bed gasification furnace capable of promoting gasification of a raw material in a simple configuration.

BACKGROUND ART

In view of a problem of petroleum exhaustion, it is recently proposed to perform gasification using petroleum coke which is a residue in petroleum refinement, low-quality coal or other fossil fuel such as oil sand, bitumen or lignite which is not effectively used as resource at present, biomass or tire chips as raw material to acquire and effectively utilize a gasification gas comprising hydrogen, hydrocarbon and the like. A circulating fluidized bed gasification furnace is disclosed in Patent Literature 1.

FIG. 1 is a schematic of a circulating fluidized bed gasification furnace represented by Patent Literature 1 and having a combustion furnace 1 (fluidized combustion furnace) for combustion of char with air 2 to heat a circulating medium. A combustion exhaust gas 3 from the combustion furnace 1 is introduced into a cyclone collector 4 where the circulating medium 5 is captured and an exhaust gas 6 is discharged. The captured circulating medium 5 is supplied through a downcomer 7 to a fluidized bed gasification furnace 8 while a gasifying agent 9 such as steam or air is supplied to a lower portion of the furnace 8 to form a fluidized bed 10. A raw material 12 is supplied to a freeboard 11 of the fluidized bed gasification furnace 8 to gasifying the raw material 12 into a gasification gas 13. The circulating medium 5 and char or unreacted solid not gasified in the fluidized bed gasification furnace 8 are returned through a circulation flow passage 14 to the combustion furnace 1 so as to burn the char.

The fluidized bed gasification furnace 8 shown in FIG. 1, which produces the highly combustible gasification gas 13, includes a sealer 15 comprising for example a U-shaped duct which blocks gas movement between the combustion and gasification furnaces 1 and 8. The downcomer 7 connected to the cyclone collector 4 has a lower end providing a sealer 16 which blocks gas movement by forming a connection such that the circulating medium 5 from the collector 4 is supplied into the fluidized bed 10 in the fluidized bed gasification furnace 8. For the sealers 15 and 16, a gasification chamber and a seal chamber connected to allow movement of the circulating medium within the fluidized bed 10 may be arranged in the fluidized bed gasification furnace 8, the circulation flow passage 14 or the lower end of the downcomer 7 being connected to the seal chamber.

In the above-mentioned circulating fluidized bed gasification furnace, the raw material 12 is supplied to the fluidized bed gasification furnace 8 by an on-bed supply mode where the raw material is supplied to the freeboard 11 on the fluidized bed 10 in the gasification furnace 8 as shown in FIG. 1 or by an in-bed supply mode where the raw material is supplied into the fluidized bed 10 in the furnace 8.

Devices representative of the in-bed supply mode include those using a screw feeder to press and supply a raw material into the fluidized bed in the combustion furnace (see, e.g., Patent Literatures 2 and 3).

CITATION LIST

Patent Literature

[Patent Literature 1] JP 2005-041959A
[Patent Literature 2] JP 2000-257828A
[Patent Literature 3] JP 57-144813A

SUMMARY OF INVENTION

Technical Problems

As described in Patent Literature 2 or 3, when the in-bed supply mode using a screw feeder to press and supply a raw material into a fluidized bed in a combustion furnace is applied to the circulating fluidized bed gasification furnace shown in FIG. 1, a residence time for contact/mixing of the raw material with the circulating medium can be kept longer because of the raw material being directly supplied into the fluidized bed, and the gasification performance can be enhanced because of a problem being alleviated for finely powder of the raw material scattering in the freeboard 11 and taken out without gasification while disadvantageously the raw material in the screw feeder may be seized by high-temperature heat of the fluidized bed, failing in stable operation. Especially when the fluidized bed gasification furnace is shut down, the supply of the raw material is stopped and the stoppage of the supply of the raw material may cause a problem that the raw material is seized due to the heat effect from the fluidized bed, making the screw feeder stuck and unable to rotate or burned-out. Thus, the in-bed supply mode requires means or measure for stably supplying the raw material, which leads to higher hardware specifications, problematically has a higher hurdle in terms of cost and operation and therefore is generally hardly employed at present.

On the other hand, the on-bed supply mode as shown in FIG. 1 can be easily implemented with little need to give consideration to problems such as heat effect as compared to the in-bed supply mode and is therefore generally employed.

However, in the case of the on-bed supply mode, the raw material 12 supplied onto the fluid bed 10 tends to move over the fluid bed 10 so that a longer residence time cannot be kept to introduce the raw material into the fluid bed 10 for contact/mixing with the circulating medium 5, and since finely powder in the raw material scatters in the freeboard 11 and is taken out without gasification, the enhancement of gasification performance is limited. Therefore, a problem exists in that the fluidized bed gasification furnace 8 must be increased in size so as to keep a longer residence time and enhance the gasification performance.

The invention was conceived in view of the above and has its object to provide a circulating fluidized bed gasification furnace capable of promoting gasification of material in a simple configuration.

Solution to Problems

The invention is directed to a circulating fluidized bed gasification furnace comprising a combustion furnace for burning char to heat a circulating medium, a cyclone collector to which a combustion exhaust gas from the combustion furnace is introduced to collect a circulating medium admixing in said combustion exhaust gas, a fluidized bed gasification furnace for formation of a fluidized bed by introducing the circulating medium collected in the cyclone collector through a downcomer and by supplying a gasification agent from below and for gasification of a raw material by supplying the same to a freeboard, and a circulation flow passage for return of the circulating medium and unreacted char not gasified in the fluidized bed gasification furnace to said combustion furnace, characterized in that the downcomer connected to said cyclone collector has a lower end connected through a sealer to the freeboard in said fluidized bed gasification furnace and that a raw material supply unit is arranged to supply the raw material to the circulating medium between the sealer and the freeboard.

In the circulating fluidized bed gasification furnace, it is preferable that the raw material supply unit comprises a screw feeder.

In the circulating fluidized bed gasification furnace, it is preferable that said sealer comprises a U-shaped duct and the raw material supply unit is connected to a tilted tube which connects the U-shaped duct with the freeboard.

Advantageous Effects of Invention

According to the circulating fluidized bed gasification furnace, the downcomer connected to the cyclone collector has the lower end connected through the sealer to the freeboard of the fluidized bed gasification furnace and the raw material supply unit is arranged which supplies the raw material to the circulating medium between the sealer and the freeboard. As a result, the raw material supplied to the circulating medium between the sealer and the freeboard is caused to get into the fluidized bed along with the circulating medium, so that a residence time for contacting/mixing the raw material with the circulating medium in the fluidized bed is kept longer than the conventional on-bed supply mode, thereby achieving an effect of significantly enhancing the gasification performance.

Moreover, since the raw material is directly mixed with and heated by the high-temperature circulating medium from the sealer and, especially, the fine powder is instantaneously heated at this point, the fine powder is gasified concurrently with the mixing or in the freeboard so that the problem is alleviated for the fine powder in the raw material scattering in the freeboard and taken out without gasification, thereby achieving an effect of further enhancing the gasification performance.

DESCRIPTION OF EMBODIMENT

An embodiment of the invention will be described with reference to the accompanying drawing.

Figure 1:
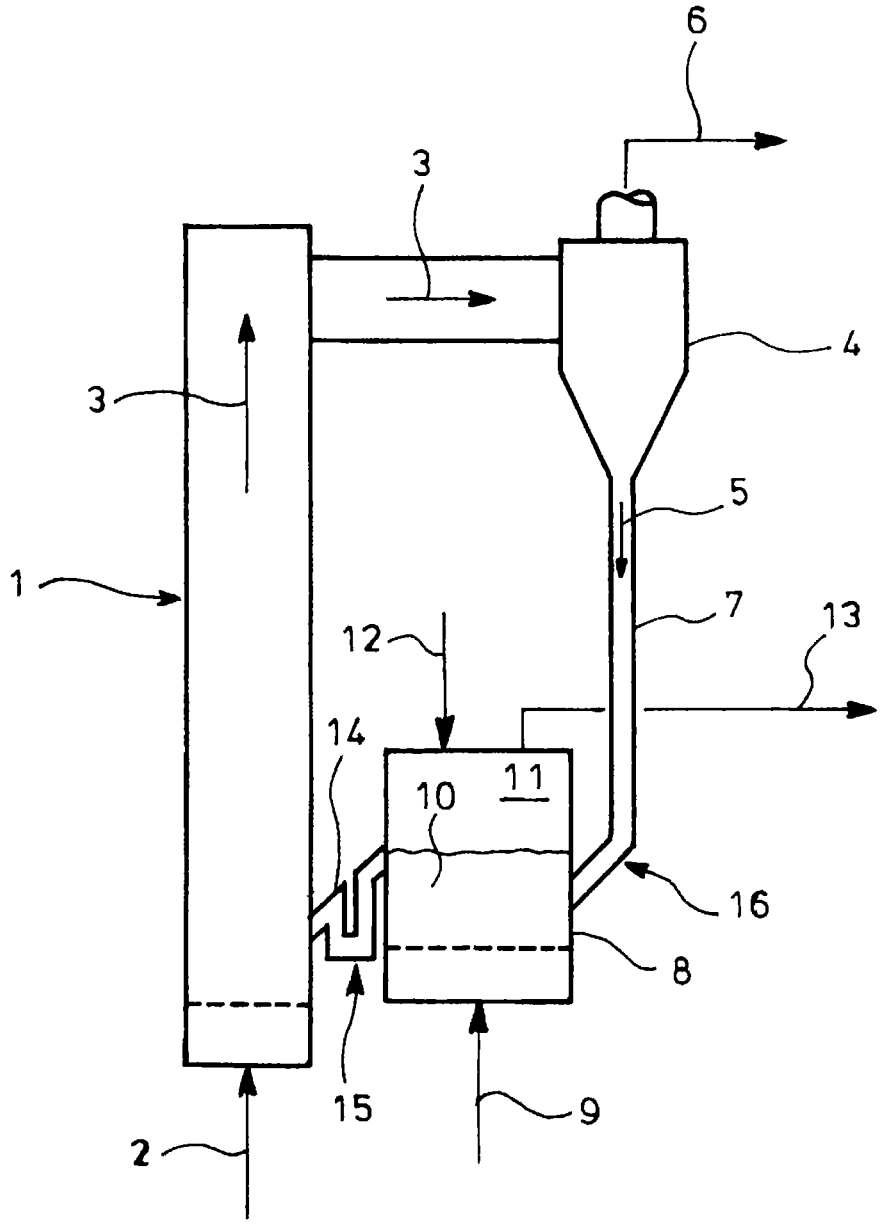
FIG. 1 Prior Art
FIG. 1 is a front view schematically showing a conventional circulating fluidized bed gasification furnace.
Figure 2:
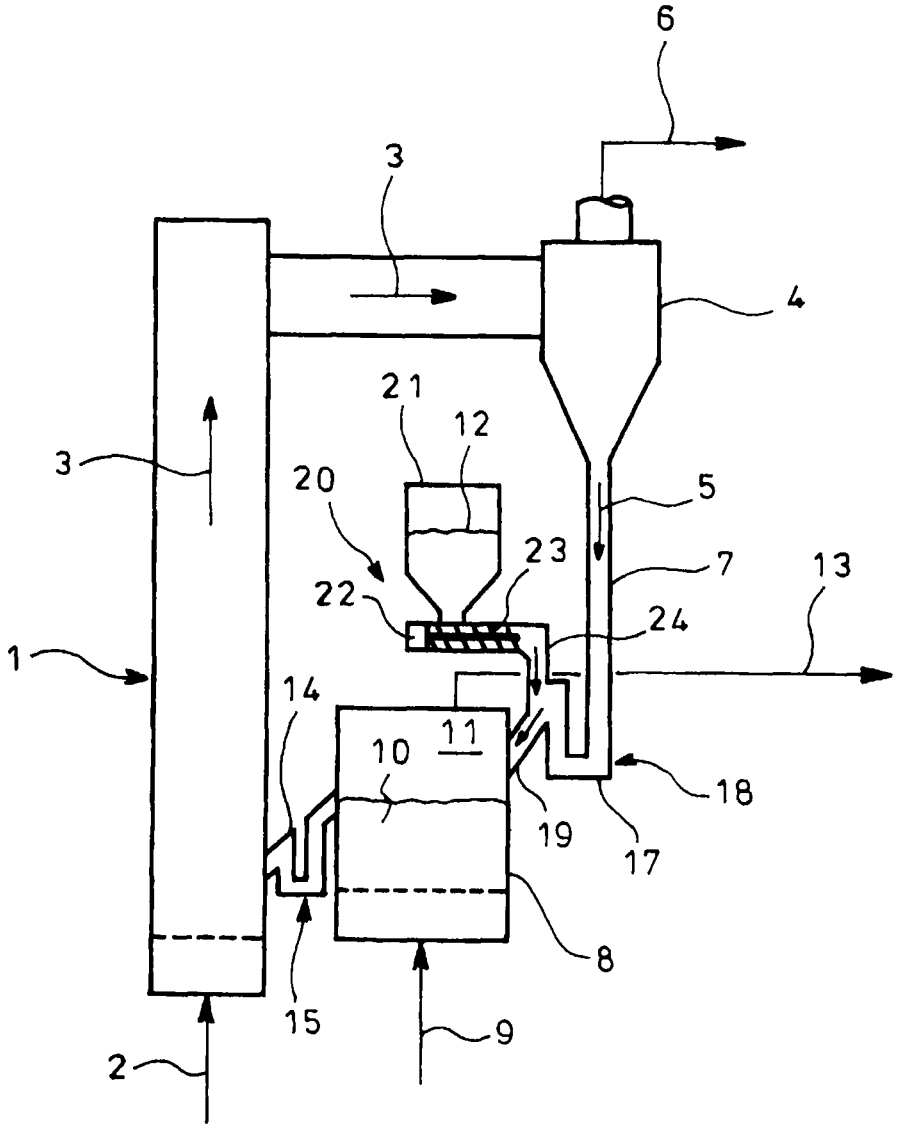
FIG. 2 is a front view showing an embodiment of a circulating fluidized bed gasification furnace of the invention.

FIG. 2 is a front view showing the embodiment of the invention applied to the circulating fluidized bed gasification furnace shown in FIG. 1. In FIG. 2, parts similar to those in FIG. 1 are represented by the same reference numerals.

As shown in FIG. 2, a cyclone collector 4, which collects a circulating medium 5 contained in a combustion exhaust gas 3 from a combustion furnace 1, is connected to an upper end of a downcomer 7 which in turn has a lower portion providing a sealer 18 comprising a U-shaped duct 17. A downwardly tilted tube 19 extends from the sealer 18 through a furnace wall into a fluidized bed gasification furnace 8 and is connected at its lower end with a freeboard 11. Thus, the circulating medium 5 from the cyclone collector 4 is supplied to the freeboard 11 through the sealer 18 and the tilted tube 19.

In the above configuration, a raw material supply unit 20 is arranged to supply a raw material 12 to the circulating medium 5 between the sealer 18 and the freeboard 11.

The raw material supply unit 20 shown in FIG. 2 comprises a screw feeder 23 connected to a bottom of a raw material hopper 21 and driven by a motor 22, so that the screw feeder 23 driven supplies the raw material 12 in the hopper 21 through a vertical supply tube 24 to the tilted tube 19.

The embodiment shown in FIG. 2 operates as mentioned below.

The combustion exhaust gas 3 from the combustion furnace 1 is introduced into the cyclone collector 4 to collect the circulating medium 5, and the collected circulating medium 5 is supplied through the sealer 18 and the tilted tube 19 arranged in the lower portion of the downcomer 7 to the freeboard 11 of the fluidized bed gasification furnace 8 and is fluidized by a gasifying agent 9 such as steam or air supplied from below to form a fluidized bed 10.

On the other hand, supplied to the tilted tube 19 interconnecting the sealer 18 and the freeboard 11 is the raw material 12 of the material hopper 21 through the supply tube 24 by driving the screw feeder 23 of the raw material supply unit 20. Since the raw material 12 is supplied to the tilted tube 19 by the screw feeder 23, the raw material 12 fills the screw feeder 23 and the filling raw material 12 prevents the gas from moving between the tilted tube 19 and the raw material supply unit 20.

Since the raw material 12 supplied to the tilted tube 19 mixes with the circulating medium 5 flowing down in the tilted tube 19 and drops into the fluidized bed 10, the raw material 12 is supplied to get into the fluidized bed 10 along with the circulating medium 5.

The raw material 12 supplied to get into the fluidized bed 10 as described above is heated by contacting/mixing with the circulating medium 5 and is gasified by the effect of the gasifying agent 9 into a gasification gas 13 which is taken out. The circulating medium and unreacted char not gasified in the fluidized bed gasification furnace 8 are returned through a circulation flow passage 14 to the combustion furnace 1 where the circulating medium is heated by burning the char.

As described above, since the raw material 12 supplied to the tilted tube 19 by the raw material supply unit 20 is supplied to get into the fluidized bed 10 along with the circulating medium 5 flowing down in the tilted tube 19, the residence time for contacting/mixing the raw material 12 with the circulating medium in the fluidized bed 10 is kept longer than the conventional on-bed supply mode, thereby significantly enhancing the gasification performance.

Since the raw material 12 supplied to the tilted tube 19 is directly mixed with and heated by the high-temperature circulating medium 5 flowing down in the tilted tube 19 and the fine powder is instantaneously heated at this point, the fine powder is gasified in the tilted tube 19 and in the freeboard 11 and, therefore, the problem is alleviated for the fine powder in the raw material 12 scattering in the freeboard 11 and taken out without gasification, thereby further enhancing the gasification performance. As described above, since the gasification performance is enhanced in a simple configuration, the fluidized bed gasification furnace 8 can be downsized as compared to the conventional on-bed supply mode.

It is to be understood that the invention is not limited to the above embodiment and that various changes and modifications may be made without departing from the scope of the invention. For example, the invention is applicable to various types of circulating fluid bed gasification furnaces.

INDUSTRIAL APPLICABILITY

A circulating fluid bed gasification furnace of the invention is applicable to efficiently enhance contact/mixing properties between a circulating medium and a raw material.

REFERENCE SIGNS LIST

1 combustion furnace
3 combustion exhaust gas
4 cyclone collector
5 circulating medium
7 downcomer
8 fluidized bed gasification furnace
9 gasifying agent
10 fluidized bed
11 freeboard
12 raw material
14 circulation flow path
17 U-shaped duct
18 sealer
19 tilted tube
20 raw material supply unit
23 screw feeder

The invention claimed is:

1. A circulating fluidized bed gasification furnace for the purpose of enhancing gasification performance in the fluidized bed gasification furnace comprising:

a combustion furnace configured to burn char to heat a circulating medium;

a cyclone collector connected to the combustion furnace and configured to to collect a circulating medium in a combustion exhaust gas from the combustion furnace;

a downcomer connected to the cyclone collector and configured to introduce the circulating medium collected from the cyclone collector;

a fluidized bed gasification furnace configured to form a fluidized bed by the circulating medium from said downcomer, a gasification agent supplied from below and a raw material supplied from a raw material supply unit to a freeboard to gasify the raw material; and a circulation flow passage configured to return the circulating medium and unreacted char not gasified in the fluidized bed gasification furnace to said combustion furnace, wherein a sealer provided by a lower end of said downcomer has a tilted tube downwardly tilted and connected to the freeboard of said fluidized bed gasification furnace, and a vertical supply tube, having a lower end connected to said raw material supply unit, is connected to said tilted tube such that the raw material from said raw material supply unit is supplied to get into the fluidized bed together with the circulating medium from the downcomer.

2. A circulating fluidized bed gasification furnace as claimed in claim 1, wherein the raw material supply unit comprises a screw feeder.

3. A circulating fluidized bed gasification furnace as claimed in claim 1 or 2, wherein said sealer comprises a U-shaped duct and the raw material supply unit is connected to a tilted tube interconnecting the U-shaped duct and the freeboard.

* * * * *